US008810344B2

(12) United States Patent
Lammers

(10) Patent No.: US 8,810,344 B2
(45) Date of Patent: Aug. 19, 2014

(54) DISCONNECTOR SWITCH FOR VOLTAGE TRANSFORMER

(75) Inventor: Arend Lammers, TV Hengelo (NL)

(73) Assignee: Eaton Industries (Netherlands) B.V., Hengelo (NL)

( * ) Notice: Subject to any disclaimer, the term of this patent is extended or adjusted under 35 U.S.C. 154(b) by 0 days.

(21) Appl. No.: 13/993,746

(22) PCT Filed: Dec. 15, 2011

(86) PCT No.: PCT/EP2011/072896
§ 371 (c)(1),
(2), (4) Date: Jun. 13, 2013

(87) PCT Pub. No.: WO2012/080392
PCT Pub. Date: Jun. 21, 2012

(65) Prior Publication Data

US 2013/0285773 A1 Oct. 31, 2013

(30) Foreign Application Priority Data

Dec. 15, 2010 (EP) ..... 10195255

(51) Int. Cl.
*H01H 9/00* (2006.01)

(52) U.S. Cl.
USPC ..... 335/179; 335/205

(58) Field of Classification Search
USPC ..... 335/179, 205–207
See application file for complete search history.

(56) References Cited

U.S. PATENT DOCUMENTS

| | | | | | |
|---|---|---|---|---|---|
| 2,057,458 | A | * | 10/1936 | Tubbs | 335/179 |
| 2,520,935 | A | * | 9/1950 | Hubbell | 335/207 |
| 3,108,163 | A | * | 10/1963 | Kripke et al. | 200/61.46 |
| 3,320,562 | A | * | 5/1967 | Germanton | 335/207 |
| 3,449,700 | A | * | 6/1969 | Gillilan | 335/188 |
| 3,534,307 | A | * | 10/1970 | Bratkowski et al. | 335/170 |
| 3,783,422 | A | * | 1/1974 | Taylor | 335/174 |
| 3,995,243 | A | * | 11/1976 | Malmborg | 335/253 |
| 4,204,180 | A | * | 5/1980 | Usui et al. | 335/205 |
| 4,258,410 | A | | 3/1981 | Boersma | |
| 4,868,530 | A | * | 9/1989 | Ahs | 335/207 |
| 4,998,082 | A | * | 3/1991 | Duimstra | 335/154 |
| 6,246,307 | B1 | * | 6/2001 | Friedman | 335/205 |
| 7,233,220 | B2 | * | 6/2007 | Batteux | 335/179 |
| 2007/0085638 | A1 | * | 4/2007 | Zindler | 335/132 |
| 2008/0272660 | A1 | * | 11/2008 | Becker et al. | 310/43 |

FOREIGN PATENT DOCUMENTS

EP 1638124 A1 3/2006

* cited by examiner

*Primary Examiner* — Shawki S Ismail
*Assistant Examiner* — Lisa Homza
(74) *Attorney, Agent, or Firm* — Leydig, Voit & Mayer, Ltd.

(57) ABSTRACT

A disconnector unit for a medium voltage application, with a conductive pen inside a housing. The conductive pen is moveable between an operational position in which an electrical contact is provided between a first terminal and a second terminal positioned inside the housing, and an off position in which no electrical contact is present between the first terminal and the second terminal. The conductive pen includes a first actuating part inside the housing, optionally, in the form of a magnet. The disconnector unit further includes a second actuating part positioned outside the housing, wherein the first actuating part and second actuating part form a non-mechanical link.

8 Claims, 5 Drawing Sheets

DISCONNECTOR SWITCH FOR VOLTAGE TRANSFORMER

CROSS-REFERENCE TO RELATED APPLICATIONS

This application is a U.S. national phase application under 35 U.S.C. §371 of International Application No. PCT/EP2011/072896, filed on Dec. 15, 2011, and claims benefit to European Patent Application No. 10195255.4, filed on Dec. 15, 2010. The international application was published in English on Jun. 21, 2012, as WO 2012/080392 A1 under PCT Article 21(2).

FIELD

The present invention relates to a disconnector unit for a medium voltage application, comprising a conductive pen inside a housing, the conductive pen being moveable between an operational position in which an electrical contact is provided between a first and a second terminal positioned inside the housing, and an off position in which no electrical contact is present between the first and second terminal.

BACKGROUND

American U.S. Pat. No. 4,258,410 discloses a voltage transformer assembly with three possible positions, connected to a conductor (rail or busbar), earth or dead (open). The entire assembly of voltage transformers with contact terminals is rotated using an external mechanical assembly to reach these positions.

An aspect of the present invention provides an improved actuation mechanism for connecting and disconnecting voltage transformers in a switch gear installation.

SUMMARY

In an embodiment, the present invention provides a disconnector unit for a medium voltage application, the disconnector unit including: a conductive pen disposed inside a housing; and a second actuating part disposed outside the housing, wherein the conductive pen is moveable between an operational position in which an electrical contact is provided between a first terminal and a second terminal disposed inside the housing, and an off position in which no electrical contact is present between the first terminal and the second terminal. The conductive pen comprises a first actuating. The first actuating part and second actuating part form a non-mechanical link.

BRIEF DESCRIPTION OF DRAWINGS

Aspects of the present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following

DETAILED DESCRIPTION

Figure 1:
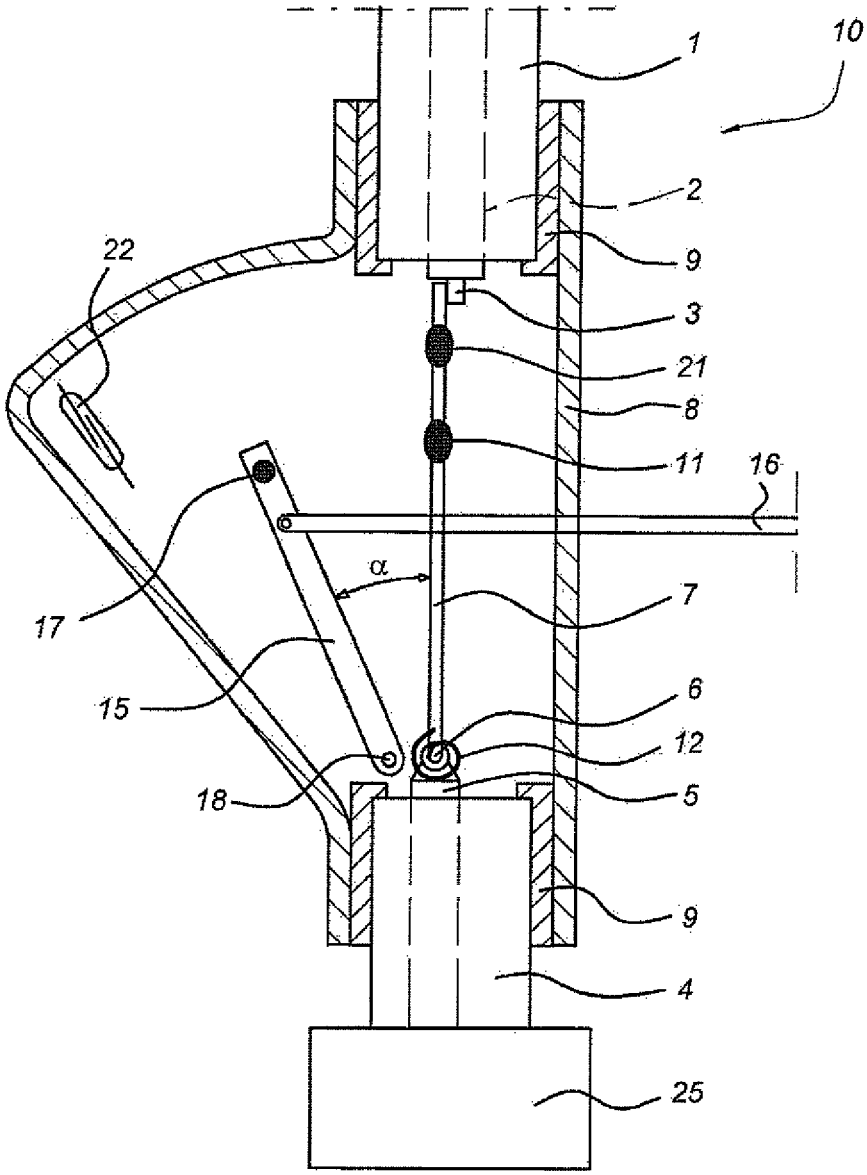
FIG. 1 shows a schematic cross sectional view of a first embodiment of the disconnector unit according to the present invention.

According to the present invention, a disconnector unit is provided, wherein the disconnector unit further comprising a second actuating part positioned outside the housing, wherein the first actuating part and second actuating part form a non-mechanical link through the material of the housing. Such a non-mechanical link or intangible link may e.g. be a magnetic force link.

In an embodiment, the first actuating part comprises a first magnet and the second actuating part comprises a second magnet. This may effectively form the non-mechanical link. As an alternative, the second magnet is an electromagnet, which can be supplied with power without problem as it is located on the outside of the disconnector unit.

The non-mechanical link is a magnetic link with attractive force between the first actuating part and second actuating part in a further embodiment. As an alternative, the non-mechanical link is a magnetic link with a repulsive force between first actuating part and the second actuating part.

In a further embodiment, the conductive pen is pivotly mounted to the first or second terminal. This allows a rotating motion of the conductive pen using the non-mechanical link. The conductive pen may have two stable positions, which allows a reliable operation of the disconnector unit using the non-mechanical link to position the conductive pen in one of the two stable positions. As an alternative, the conductive pen has one stable position. This allows to have the conductive pen to return to the stable (e.g. safe) position even when the non-mechanical link is inoperable.

The housing comprises two symmetrical halves in a further embodiment allowing easy assembly of the disconnector unit. In an alternative embodiment, the housing comprises a cylindrical part and a closing lid. Although such an embodiment requires more space, assembly is made very easy.

In a further embodiment, the disconnector unit further comprises a position sensor outside of the housing, allowing positive feedback of the status of the disconnector unit at all times.

The present invention embodiments relate to a solution for providing a disconnection of voltage transformers used in (medium voltage) switch gear installations or applications. Voltage transformers are widely used in switching installations for monitoring purposes, ranging from basic switching units to complex switching stations.

A switching installation can be subjected to several types of tests for maintenance purposes or operational purposes. One of such tests is a power frequency test, for which voltage transformers in the switching installation need to be disconnected. Disconnection can e.g. be implemented by lowering or lifting the transformers (which is a heavy task), or by using a manually or electrically driven disconnector switch.

In the present invention embodiments, the disconnection of voltage transformers is implemented using a totally insulated disconnector unit 10 with a non-mechanical (e.g. magnetic) actuation effected through an enveloping housing 8, i.e. without a mechanical link penetrating the housing through some kind of physical aperture. The disconnector unit 10 is thus totally insulated and doesn't pose any issues relating to high voltages, while the construction can still be simple and compact.

FIG. 1 shows a schematic cross sectional view of a disconnector unit 10 according to a first embodiment of the present invention. On the top part of the drawing, a connection cable 1 with a conductor 2 is shown, which is connected to a part of a switching installation where a voltage needs to be measured, such as a rail or busbar. The conductor 2 is provided with a first contact terminal 3.

On the bottom side of the drawing, a cable 4 is shown with a conductor 5, which is connected (hard-wired) to a voltage transformer 25. The conductor 5 is provided with a second contact terminal 6. A conductive pen 7 is provided which is moveable between an operational position in which an electrical contact is provided between the first contact terminal 3 and the second contact terminal 6 (in order to connect the voltage transformer 25 for voltage measurements) and an off position in which no electrical contact is present between the first and second terminals 3, 6. In the embodiment shown, the conductive pen 7 is connected to the second contact terminal 6 using a pivoting connection.

An insulating enveloping housing 8 is provided between the connection cable 1 and cable 4, using a sealing 9 at the top and at the bottom part of the housing 8, in order to provide an air tight, clean and sealed off environment inside the insulating housing 8. The insulating housing 8 is e.g. made of an insulating material, such as polycarbonate, which allows easy manufacturing using e.g. (injection) molding techniques. A polycarbonate has the advantage of being transparent, allowing visual inspection of the mode or status of the disconnector unit 10.

In the embodiment shown, the conductive pen 7 is attached to the second contact terminal 6 in a pivoting manner. The insulating envelope 8 is provided with an extending part (seen perpendicular to an axis through cable 1 and cable 4) allowing rotation of the conductive pen 7 over an angle $\alpha$. This will allow sufficient separation between the conductive pen 7 and the first terminal 3 in a high voltage environment (e.g. 10-15 cm). A spring 12 is provided which pre-tensions the conductive pen 7 into contact with the first contact terminal 3. The conductive pen 7 comprises a first actuating part inside the housing, in this embodiment comprising a first magnet attached to the conductive pen 7.

On the outside of the insulating housing 8, an actuation assembly is provided in the form of a second actuating part comprising a pivoting strip 15 (attached in a pivoting point 18 on the outside of the housing 8) and an actuating strip 16, which e.g. protrudes from the front side of a switching installation, allowing manual actuation of the disconnector unit 10. Both the pivoting strip 15 and the actuation strip 16 are e.g. made of an insulating material, such as a plastic material.

The conductive pen 7 is provided with the first magnet 11 at a first distance from the second contact terminal 6. The first magnet 11 is positioned close to an inside wall of the insulating housing 8 in one specific embodiment, e.g. using an extension element 11*a* attached to the conductive pen 7 (see also the embodiment of FIG. 2-4 below).

The pivoting strip 15 is provided with a second magnet 17, at a second distance from the associated pivoting point 18, the first and second distance being substantially equal. In a further embodiment, the second magnet 17 may be implemented as an electromagnet, which can be supplied with power from outside the insulating housing 8.

The first and/or second magnet 11, 17 may be made from modern magnet materials (e.g. comprising composite materials and/or rare earth materials such as samarium-cobalt, neodymium-iron-boron, etc.), providing a high attraction force at the relevant distance between the first and second magnets 11, 17.

As a result, the first actuating part (first magnet 11) and second actuating part (second magnet 17) form the non-mechanical link.

By actuating the actuator strip 16, the pivoting strip 15 is rotated around the pivoting point 18. When the second magnet 17 is close to the first magnet 11, they will attract each other, making a magnetic (non-mechanical) link between the pivoting strip 15 and conductive pen 7. In an exemplary embodiment, the minimum distance between the first magnet 11 and second magnet 17 is about 0.5 cm. This allows to pivot the conductive pen 7 away from the first contact terminal 3 by moving the actuator strip 16. As the conductive pen 7 is electrically connected to a voltage transformer 25, only a limited current will flow through the conductive pen 7 in operation (e.g. less than 1 A), allowing separation of the conductive pen 7 and first contact terminal 3 using moderate forces which can be provided using the magnetic link.

Figure 2:
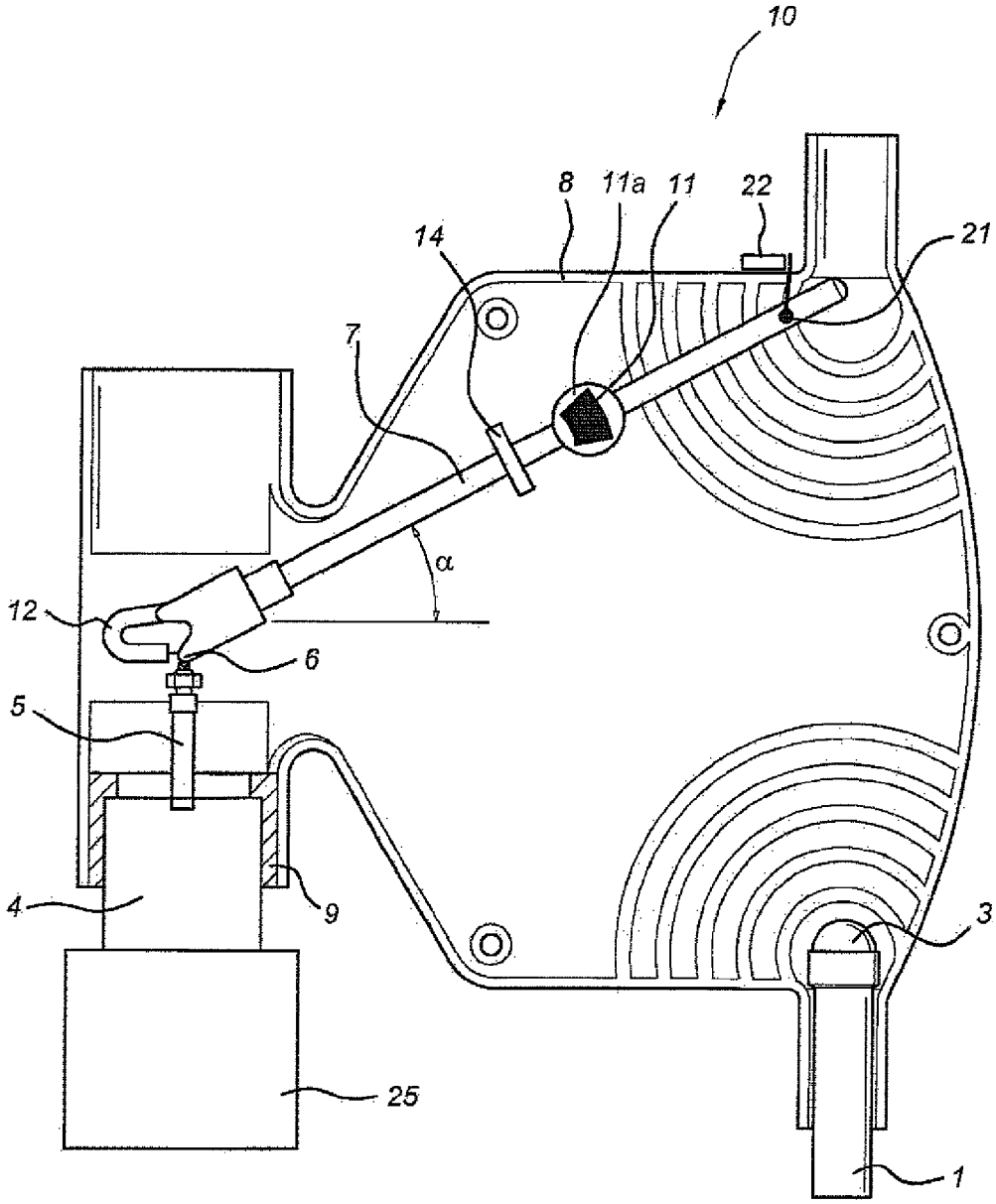
FIG. 2 shows a cross sectional view of a second embodiment of the disconnector unit according to the present invention.
Figure 3:
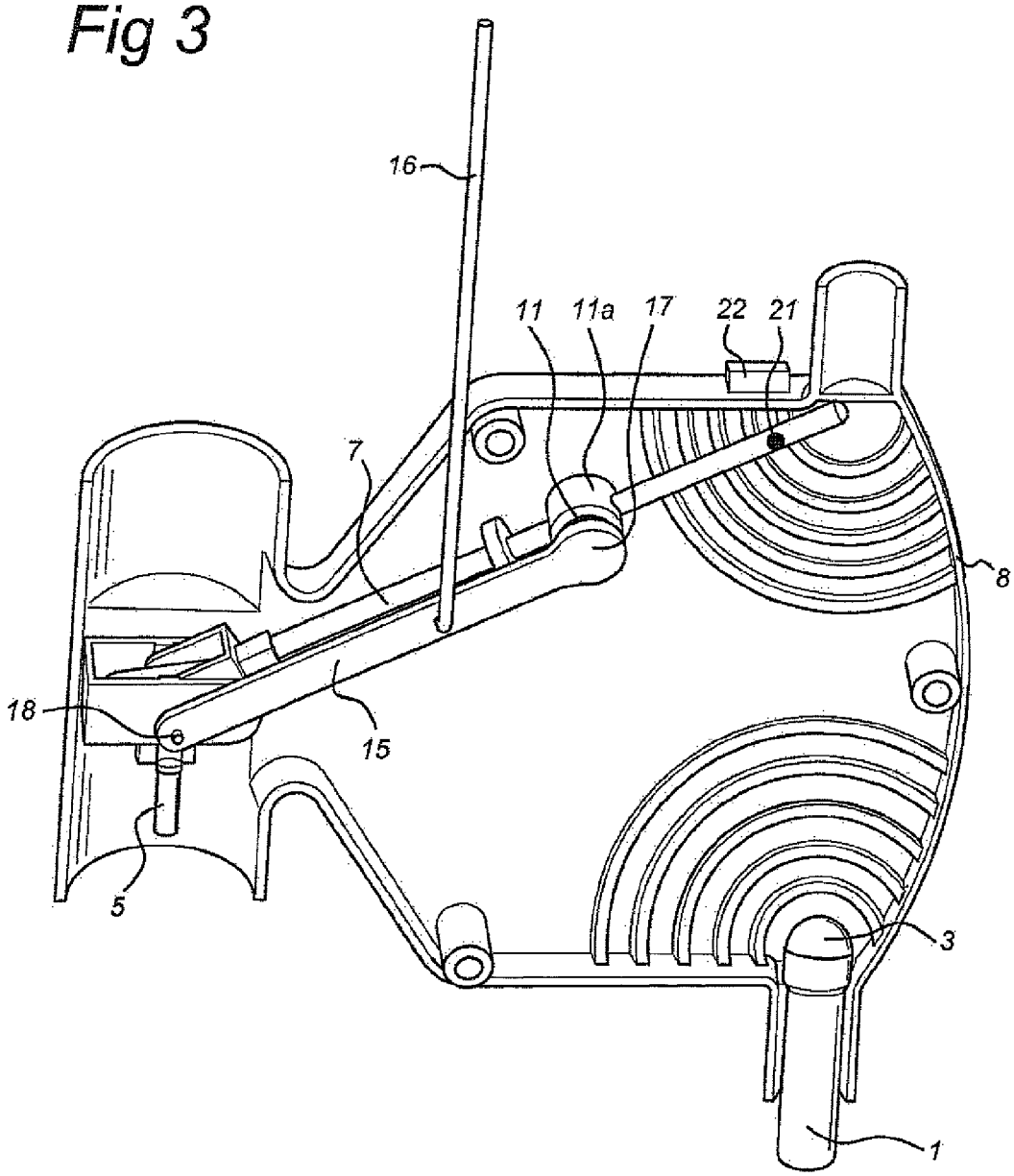
FIG. 3 shows a perspective view of the embodiment of FIG. 2 with part of the housing removed.
Figure 4:
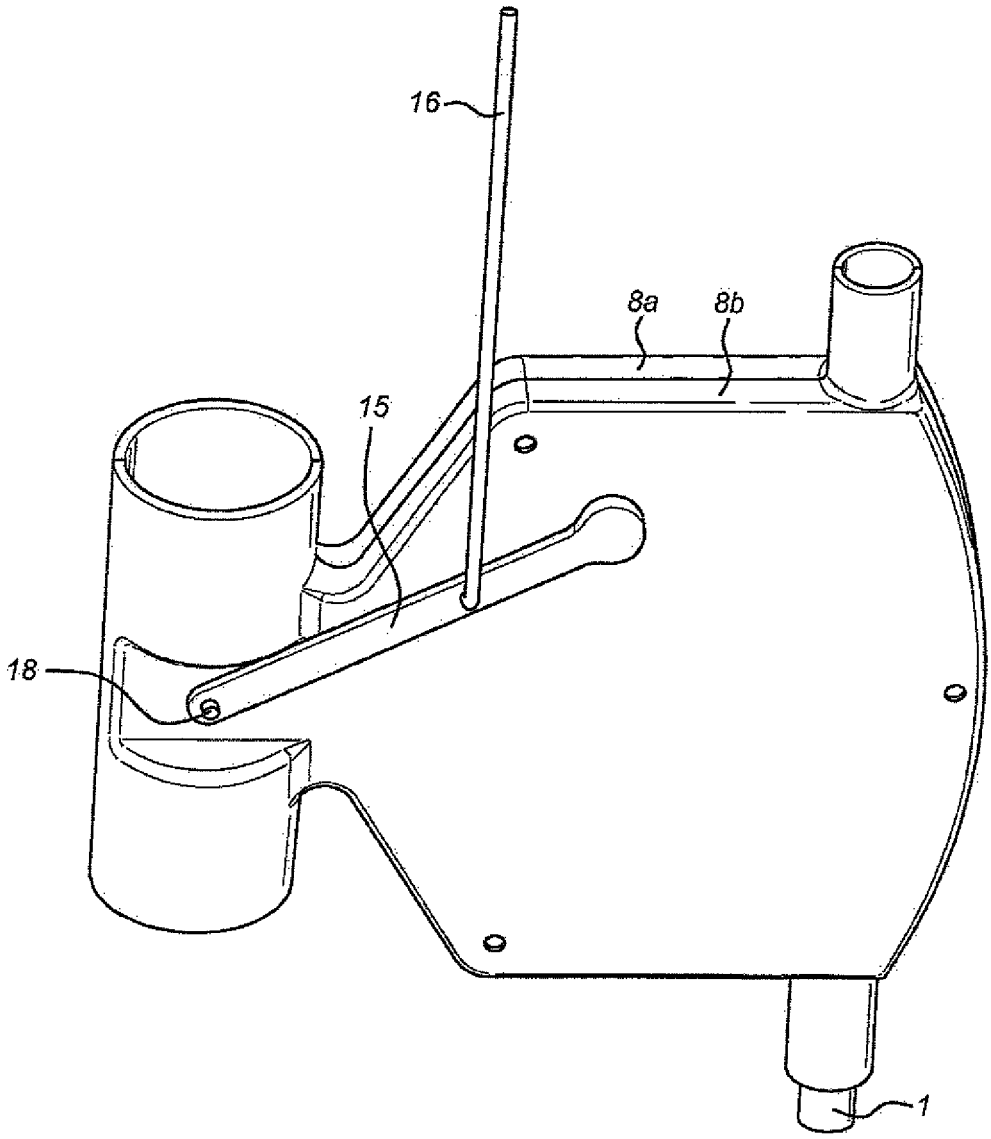
FIG. 4 shows a perspective view of the outside elements of the embodiment of FIG. 2.

FIG. 2 shows a schematic cross sectional view of a disconnector unit 10 according to a second embodiment of the present invention, showing the internal elements of the disconnector unit 10, i.e. the elements within a housing 8. FIG. 3 shows a perspective view of the disconnector unit 10 of FIG. 2, with a part of the housing 8 removed, but also showing elements external to the housing 8. FIG. 4 shows an external view of the disconnector unit 10 of FIGS. 2 and 3.

In this embodiment the housing 8 has a symmetrical shape, and in the embodiment shown, both the cable 1 and the voltage transformer 25 are positioned below the housing 8. The conductive pen 7 is pivotly mounted at the second contact terminal 6, and is forced in one of two stable positions by the spring 12, i.e. either against the top of the housing 8, or against the bottom part of the housing, i.e. first contact terminal 3. In order to allow proper movement of the conductive pen 7 inside the housing, the pen 7 is provided with a guiding part 14 about halfway of the pen 7.

In a further embodiment, the conductive pen 7 is not provided with a spring 12, and relies on e.g. gravity to provide one stable position (i.e. in contact with the first contact terminal 3).

In FIG. 3 the external elements are also shown, i.e. the actuator strip 16 (here in the form of a bar translating in a vertical direction in the drawing) and pivoting strip 15. The pivoting strip 15 is mounted in a pivoting point 18, coinciding with the pivoting point of the second contact terminal 6 inside the housing. The second magnet 17 is provided at an end of the pivoting strip 15, at a similar distance from its pivoting point 18 as the distance between first magnet 11 and its associated pivoting point (at second terminal 6).

In the perspective view of FIG. 1, the extension element 11*a* is shown clearly, which provides the first magnet 11 as close to the housing as possible.

In the perspective view of FIG. 4, the composite housing 8 of this embodiment is shown more clearly as comprising two housing parts 8*a* and 8*b*, which are two symmetrical halves. The housing 8 in this embodiment is flat, as only space is allowed for the movement of the conductive pen 7 between two extreme positions as discussed above. However, care should be taken that the two housing parts 8*a* and 8*b* are mounted together in a manner sufficient to withstand a high voltage environment, e.g. using mirror welding or gluing.

Figure 5:
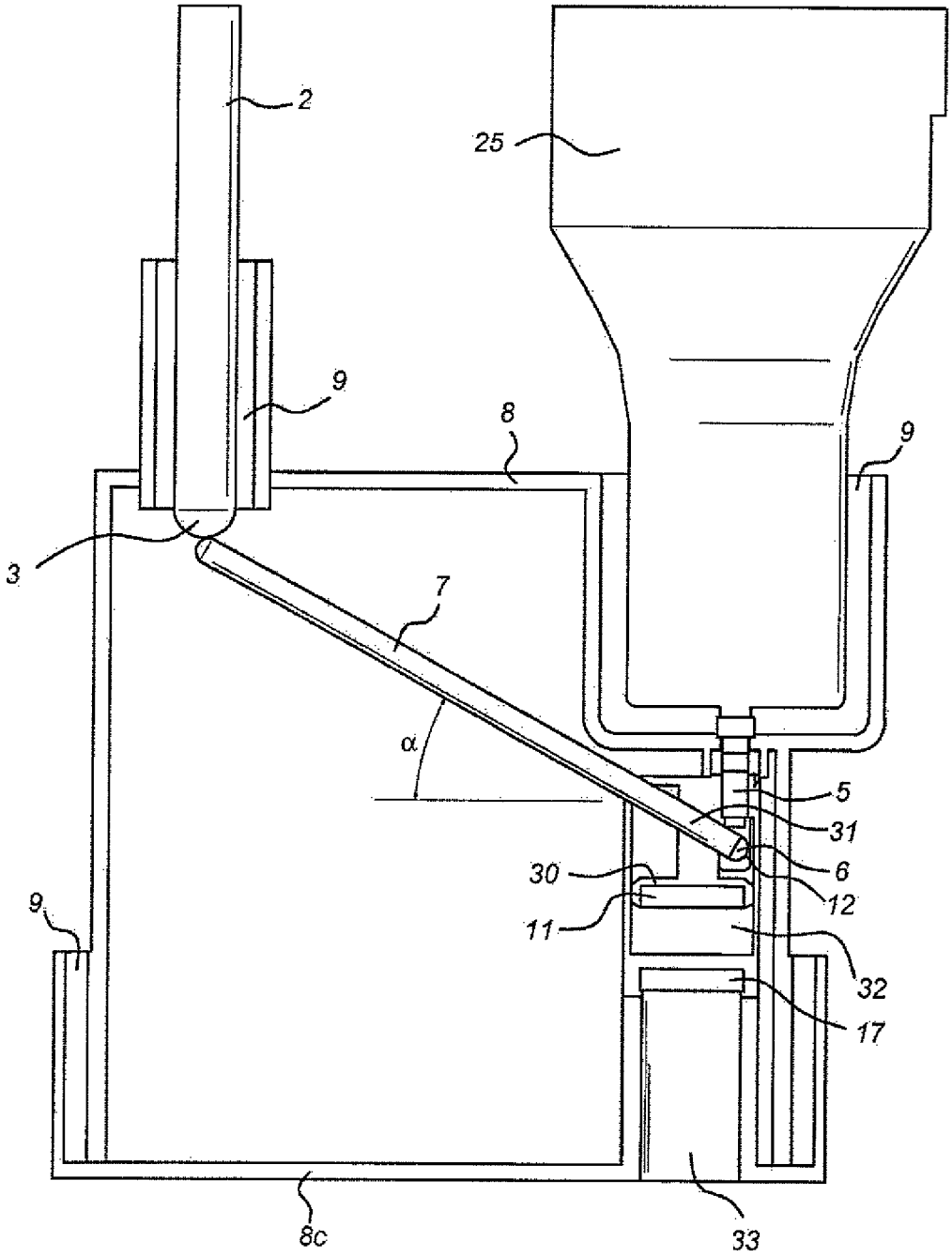
FIG. 5 shows a cross sectional view of a third embodiment of the disconnector unit according to the present invention.

In the cross sectional view of FIG. 5, a third embodiment of the present invention is shown. The conductor 2 carrying the voltage to be measured and the voltage transformer 25 are connected at the top of the housing 8 of the disconnector unit 10. The housing 8 in this embodiment has the shape of a cylindrical part or pot, which is closed off by a closing lid 8*c* on the bottom using seals 9 at the (three) interfaces between lid 8*c*, conductor 2, cable 4 of the voltage transformer 25 and the housing 8.

In this embodiment the conductive pen 7 is mounted in a pivotable manner onto the second terminal 6 of the conductor 5 (i.e. the conductive pen 7 is able to pivot in the direction $\alpha$ as indicated in FIG. 5). At a short distance away from the second terminal 6, a second pivoting point 31 is provided in the conductive pen 7, to which an actuating part 30 is connected. In the actuating part a first magnet 11 is provided. The housing 8 is provided with a guiding channel 32, allowing the actuating part 30 to move up and down only, i.e. a linear translating movement. In the embodiment shown in FIG. 5, a spring 12 is provided in the pivoting point near the second terminal 6, forcing the conductive pen 7 into contact with the first terminal 3. In this embodiment the conductive pen 7 of the disconnector unit 10 has two stable positions.

The lid 8*c* of the housing 8 is provided with a further guiding channel 33, accessible in operation from the outside of the housing 8, which provides space for a second magnet 17. When the second magnet 17 is brought closer to the first magnet 11, a magnetic driving force is generated, and the actuating part 30 is forced downward. As a result the conductive pen 7 is moved to the off position, the end of the conductive pen 7 being at a distance away from the first terminal 3 which is sufficient in the high voltage environment.

In an alternative of the embodiment of FIG. 5, a repulsive force between the first magnet 11 and second magnet 17 is used to operate the disconnector unit 10 with the non-mechanical or intangible link. In this case, the pre-tensioning spring 12 is not provided, as a result of which the conductive pen 7 is in an off position when the first and second magnet 11, 17 are not within their mutual influence range. In other words, in this embodiment, the conductive pen 7 has one stable position. When the second magnet 17 is moved nearer to the first magnet 11, a repulsive force is generated driving the actuator part 30, and hence the conductive pen 7, in its operational position, i.e. upward in contact with the first terminal 3 of conductor 2.

The movement of the second magnet 17 may in these embodiments be achieved using a linear actuating rod 34.

In even further embodiments, the conductive pen 7 may be implemented as a displaceable pen, e.g. using rails or other guiding means provided in the inside of the insulating housing 8. The actuator movement can then e.g. be a linear movement of the conductive pen 7 between an off position and an operative position. The actuation mechanism on the outside of the insulating housing 8 can then also be implemented as a linear actuator (e.g. by providing the second magnet 17 directly on the actuating strip 16.

For (remote) signaling purposes, the position of the conductive pen 7 in the 'off' position may be sensed using a position sensor. The position sensor may be embodied as an additional magnet 21 on the conductive pen 7, in combination with a reed sensor 22 positioned on a corresponding location on the outside of the insulating housing 8, as shown in the embodiments of FIG. 1-4. Such a remote sensor may also be applied in the embodiment of FIG. 5. In alternative embodiments the position sensor may be based on optical measurement, e.g. through a transparent insulating housing 8.

The present invention embodiments have been described above with reference to a number of exemplary embodiments as shown in the drawings. Modifications and alternative implementations of some parts or elements are possible, and are included in the scope of protection as defined in the appended claims.

The terms used in the attached claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise.

The invention claimed is:

1. A disconnector unit for a medium voltage application, the disconnector unit comprising:

a conductive pen disposed inside a housing; and a second actuating art having a second magnet disposed outside the housing, wherein the conductive pen is moveable between an operational position in which an electrical contact is provided between a first terminal and a second terminal disposed inside the housing, and an off position in which no electrical contact is present between the first terminal and the second terminal, wherein the conductive pen comprises a first actuating part having a first magnet, and wherein the first actuating part and second actuating part form a non-mechanical link by the first and second magnets being disposed at corresponding locations on opposite sides of a wall of the housing such that the magnets slide together along the respective opposite sides of the wall of the housing.

2. The disconnector unit of claim 1, wherein the second magnet is an electromagnet.

3. The. disconnector unit of claim 1, wherein the conductive pen is pivotably mounted to the first or second terminal.

4. The disconnector unit of claim 1, wherein the conductive pen has two stable positions.

5. The disconnector unit of claim 1, wherein the conductive pen has one stable position.

6. The disconnector unit of claim 1, wherein the housing comprises two symmetrical halves.

7. The disconnector unit of claim 1, wherein the housing comprises a cylindrical part and a closing lid.

8. The disconnector unit of claim 1, wherein the disconnector unit further comprises a position sensor disposed outside of the housing.

* * * * *